US005133473A

United States Patent [19]

Piltz et al.

[11] Patent Number: 5,133,473

[45] Date of Patent: Jul. 28, 1992

[54] CONTAINER CLOSURE

[75] Inventors: Lars-Erik Piltz, Norrangavagen; Patrick Duvander, Anggatan, both of Sweden

[73] Assignee: AB Akerlund & Rausing, Sweden

[21] Appl. No.: 746,168

[22] Filed: Aug. 14, 1991

Related U.S. Application Data

[63] Continuation of Ser. No. 529,967, May 29, 1990, abandoned.

[30] Foreign Application Priority Data

Jun. 9, 1989 [SE] Sweden ..... 89020804

[51] Int. Cl.[5] ..... B65D 17/34

[52] U.S. Cl. ..... 220/270; 220/266; 220/268

[58] Field of Search ..... 220/265, 266, 268, 269, 220/270, 276

[56] References Cited

U.S. PATENT DOCUMENTS

| | | | |
|---|---|---|---|
| 3,281,007 | 10/1966 | Dorosz | 220/270 |
| 3,373,895 | 3/1968 | Arfert . | |
| 3,425,591 | 2/1969 | Pugh, Sr. | 220/270 |
| 3,836,038 | 9/1974 | Cudzik | 220/270 |
| 4,324,342 | 4/1982 | Yamaguchi et al. | 220/268 |
| 4,576,305 | 3/1986 | Saunders | 220/269 |
| 4,850,503 | 7/1989 | Larsson | 220/266 |

FOREIGN PATENT DOCUMENTS

| | | |
|---|---|---|
| WO8204026 | 11/1982 | PCT Int'l Appl. . |
| 2216093 | 10/1989 | United Kingdom . |

*Primary Examiner*—Stephen Marcus
*Assistant Examiner*—Paul A. Schwarz
*Attorney, Agent, or Firm*—Lerner, David, Littenberg, Krumholz & Mentlik

[57] ABSTRACT

Plastic container closures which are preferably injection molded through a centrally placed ingot are disclosed. The closures include a cover panel with a circumferential rim and a pouring opening which corresponds to only a portion of the area of the cover panel. The closure also includes an integral grip and a tearing denotation provided by a reduced thickness groove in the cover panel around the periphery of the portion of the cover panel which is to be removed and in which that groove extends from a point in the proximity of the circumferential rim towards a point displaced from the center of the cover panel at a location beyond the center with respect to the first point, and in which the reduced thickness groove is interrupted to provide a hinge for the portion of the cover panel to be removed subsequent to opening.

4 Claims, 2 Drawing Sheets

CONTAINER CLOSURE

This is a continuation of application Ser. No. 07/529,967 filed May 29, 1990 now abandoned.

FIELD OF THE INVENTION

The present invention relates to container closures, more precisely closures of containers for liquid or at least pourable filling goods.

The problem of the invention is to provide a closure manufactured from plastics material, which alone or in combination with a layer of metal or another material or plastics having high barrier characteristics provides the required tightness, but also an easy openable structure.

BACKGROUND OF THE INVENTION

Definitely, there is a need for replacing prior art container closures manufactured from metal. Metal, for instance, is a heavy material, even in that case where the metal is aluminum. Frequently, a metal cover results in sharp edges when the cover is torn up, which of course is a major drawback from a damage point of view, not only when opening but also when handling the cover and especially when leaving a can and the cover attached thereto out in the countryside.

In a number of countries prohibitions have already been launched against spreading around loose, sharp metal parts, for instance metal pieces torn away from cover panels.

Although the problems relating to such metal pieces have been solved by means of a tongue or a flap which is still attached to the container after the tearing operation, the drawback remains that metal tongues which are torn away from a closure panel necessarily have to be pushed down into the package before pouring the filling goods. This results in an undesired contaminating effect on the contents of the package.

The prior art container closures of metal necessitate a large input of production machinery and the manufacturing requires large energy quantities. Because it all goes around extremely complex machinery, and because ultrahigh production speeds are used for making the production competitive, it is realized that the pattern of movement in the machinery has to be the simplest possible in order not to waste time.

Thus, the traditional application of a pull ring on the panel requires that the ring be placed centrally. If not, time will be wasted for orientation of individual packages, which is not possible in practice.

The technique used for metal closures generally involves punching, deep-drawing, riveting and so called curling and birdling, respectively, for mounting a cover on to the end of a container casing. Before this is possible, however, at least two of said manufacturing steps have to be completed, generally in combination with a final adjustment step.

In addition to the cost of material, the manufacturing cost will then be an economically heavy burden for manufacturing said closure end pieces, which as such actually do not have any intrinsic value.

OBJECT OF THE INVENTION

The object of the present invention is to offer a "plastics alternative" for the prior art metal closures. Firstly, this means a cost reduction in terms of material as well as production.

Furthermore, said alternative offers a much more flexible end structure in terms of design. This end structure is focused on the convenience of the consumer as well as safety plus a minimum affection of the packening contents by a torn-up tongue or similar element when completing the opening of the container.

The design flexibility obtained by the plastics technique according to the invention offers not only a convenient pouring of the product through the pouring opening but does also imply a fixing of the grip device of the opening-up facility when tearing up a pouring opening. By a corresponding design of for instance an injection molding tool, practically any opening pattern may be realized—patterns completely impossible in connection with container closures of metal.

SUMMARY OF THE INVENTION

Thus, the invention provides a container closure, comprising a cover panel having a circumferential rim, an opening arrangement provided on the cover panel having a grip portion and a tearing denotation starting out therefrom for defining a pouring opening. The invention is characterized in that the pouring opening has a pouring area corresponding merely to a portion of the total panel area, and that the pouring opening defined by said tearing denotation extends from a point close to the outer margin to a distal point beyond the central portion of the panel.

In one embodiment of the present invention, the point close to the outer margin is located at a section of the tearing denotation having a certain, longer radius of curvature than the radius of a second section on which the distal point is located.

In the preferred embodiment the tearing denotation is obtained as a generally, possibly with a smaller interruption, integral, line-shaped denotation of a material having a reduced thickness.

In the preferred embodiment also the container closure is manufactured of a plastics material.

In another embodiment there is provided a container closure comprising a cover panel having a circumferential rim and an opening arrangement on the closure panel having a grip portion from which a tearing denotation starts out for defining a pouring opening. The container closure is characterized in that the pouring opening has a pouring area corresponding to a portion only of the total panel area, that a strap portion starting out from the grip defines a first sub-region of the pouring opening, and that said strap-shaped portion emerges into a second portion defining the rest of the pouring opening.

Preferably, the pouring opening is defined by an internal material weakening line formed into a rounded wedge-shape, where the small end of the wedge is located at a further distance from the outer margin of the closure than the large end.

In another embodiment of the invention there is provided a container closure, comprising a cover panel having a circumferential rim and an opening arrangement arranged on the cover panel and provided with a grip portion and a tearing denotation starting out from said grip portion for defining a pouring opening. The invention is characterized in that the pouring opening has a pouring area corresponding only to a portion of the total panel area, that the tearing denotation is formed by a material weakening groove in the lower side of the panel, and that the groove ends at a distal portion related to the outer margin of the panel and at that portion forms a ledge for folding up a portion of the panel corresponding to the pouring opening.

In a further embodiment the invention provides a cover panel having a circumferential rim and an opening arrangement on the cover panel having a grip portion and a tearing denotation starting from there for defining a pouring opening. The invention is characterized in that the pouring opening has a pouring area corresponding only to a portion of the total panel area, and has an extension from a point close to the periphery of the panel to a point beyond a central region of the panel, and that from the portion removed from the pouring opening, except for the region of said hinge, the removed portion is such that a part thereof is attachable to the external side of the rim of the closure.

Said ring attachable to the rim preferably comprises a pull ring and a strip integral therewith, which by deformation tension in the strap material presses the ring against the outside of the rim.

According to a further embodiment of the invention there is provided a container closure, comprising a cover panel having a circumferential rim and an opening arrangement on the cover panel having a grip portion and a tearing denotation starting out therefrom for defining a pouring opening. The invention is characterized in that the portion of the pouring opening is defined by a strap-formed part of the panel attached to said grip portion, and at the side of the panel where the grip portion is located, ledges are provided in the panel along the strip shaped portion of the panel, and that tearing denotations in the shape of a groove are arranged at the opposite side of the panel in register with said ledges.

DESCRIPTION OF THE PREFERRED EMBODIMENT

Figure 1:
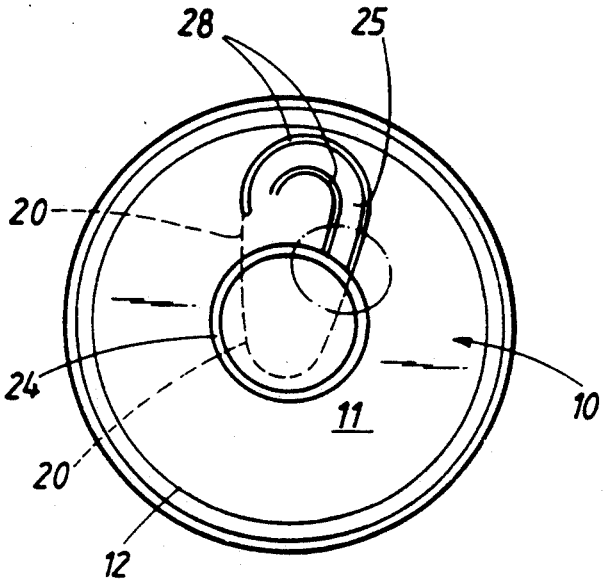
FIG. 1 is a view from above of end closure according to the invention.

The container closure 10 in FIG. 1 comprises a cover panel 11 delimited by a generally circular border line 12. This border line 12 also forms the lower border line for a rim 13 having a somewhat conical envelope surface 14 extending outwardly from the panel 12. The inner envelope surface 14 emerges into an outer rim or flange 16 by an upper circumferential portion 15 and the flange is shorter than the inner rim. Between the outer rim 16 and the inner rim, the extension thereof being defined by the conical surface 14, there is formed a groove 17 for accommodating the end edge of a container casing.

Figure 4:
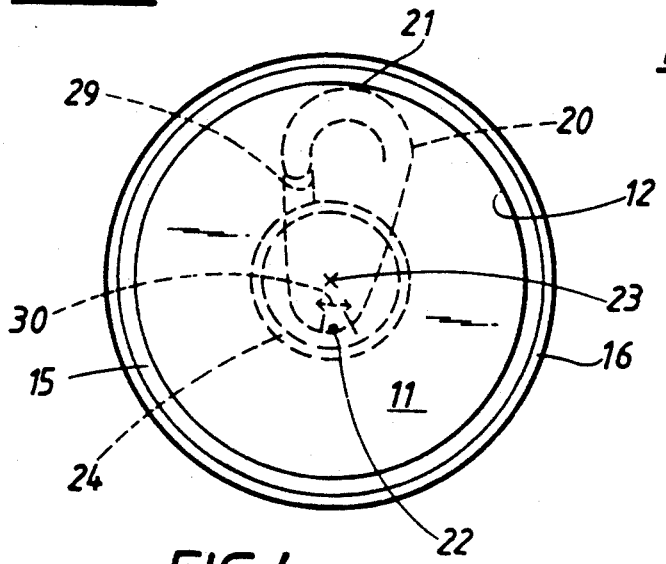
FIG. 4 shows the end closure in FIG. 1 seen from below, or from the side to be turned against the interior of the container, FIG. 5 schematically shows the enclosure in FIG. 1 torn open.

In that case where the material of the end closure 10 is a common moldable plastics material, for instance polyprophylene or other suitable polyolefin or thermoplastics material having insufficient barrier characteristics, the cover 10 is supplemented by a gas tight layer 18, for instance of metal foil or a suitable plastics laminate or high barrier plastics film. The attachment of the material forming the layer 18 is carried out in any suitable manner, for instance by high frequency welding, and the welding is made either along the entire area of the bottom 19 of the closure 10 or such that there is a welded region at both sides of a closed welding line 20 defining an openable region defining the area of the pouring opening and which in FIG. 4 has a generally rounded wedged shape.

The starting point of line 20 defining the pouring opening relative the proximal point 21 of the pouring opening edge is located adjacent to the circular border line 12 of the cover panel 11, and the distal point 22 is located at a relatively long distance, normally 5 to 10 mm, beyond the central portion 23 of the end of closure 10. The point 21 is located at a curve section having a larger radius than the curve section where the point 22 is located.

A pull ring 24 is located centrally on the side of the container closure 10 to be turned outwardly and a strip shaped portion 25 forms a transition to a second portion 26 corresponding to the remainder of the pouring opening 27 formed by the weakening line 20.

The pull ring 24 emerges into the strap 25 via a pair of material thickening ribs 28 on the side of the container 10 intended to be the outside. Said ribs 28 are located in register with the extension of the underlaying, closed weakening line 20 and a shorter, not closed weakening line 29, which also is arranged in register with a corresponding short rib 28 on the opposite side of the panel 11.

Figure 6:
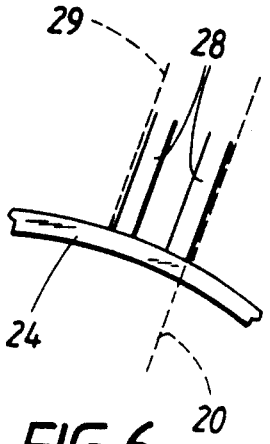
FIG. 6 is a schematic partial view showing the encircled region in FIG. 1.
Figure 2:
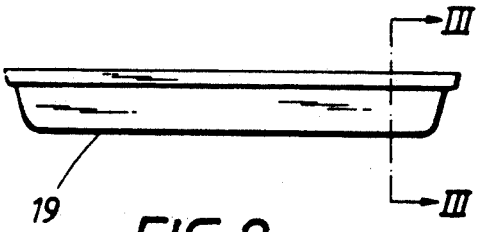
FIG. 2 is a side view of the closure of FIG. 1.
Figure 3:
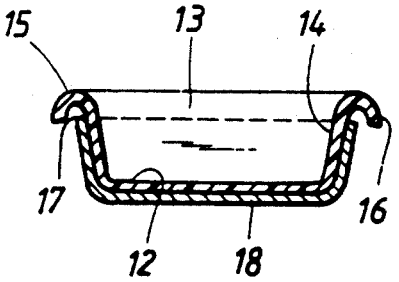
FIG. 3 is a section along line III—III in FIG. 2.

The individual positions of the weakening lines 20, 29 and the rib 28 appear from FIG. 6.

The end closure 10, exclusive the inner layer 18, is integrally injection molded through one centrally placed ingot, an ingot in the region of the central portion 23. The material is a polyolefin proper for the actual application or another plastics material well suited for injection molding.

By a corresponding design of the tube mold halves used for injection molding, the extension of the border lines 20 of the pouring opening may be placed without restrictions and without eliminating freedom degrees, such that the end 22 of the weakening line 20 distal to the outer margin 12 of the panel 11 lies at a distance well beyond the center 23 of the end closure. This results in that the emptying of the container continues smoothly and nicely without disturbing "klonks" and temporary interruptions.

Figure 5:
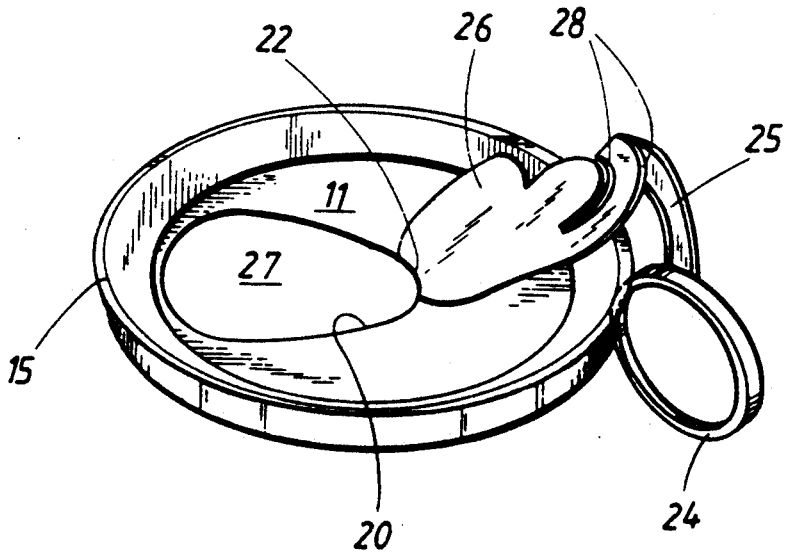

Due to the fact that in the region 30, adjacent to the distal point 22, the weakening line 20 is interrupted a short distance, by simple means there is arranged a remaining hinge for folding out the piece 26, the strap 25 and the ring 24 from the panel 11, see FIG. 5.

By positioning the point 22 properly and by dimensioning the strap and ring 24 in the same manner, the inherent tension of material in the strap 25 and piece 26 will provide for the arrangement according to FIG. 5. Here, the dimensions are such that the pull ring 24 is snapped under and maintained in position by the outer rim 16.

Normally, the initial phase is critical when tearing up a plastics cover. Having this in mind materially reinforcing ribs 28 are arranged according to the invention, and together the ribs form a narrow strap 25 to which the pull strap 24 is attached.

This small strap has weakening lines 20, 29 at the opposite side of the panel 11, the whole way up to the point where the strap 25 ends and the partial region 26 begins. This reinforcement of the initial tearing up means a further safety factor when opening the container.

Although the invention describes merely one embodiment, it is realized that further modifications and versions are possible within the scope of the patent claims.

We claim:

1. A container closure for a container having an end, said closure comprising a plastic cover panel for covering said end of said container, said cover panel having a center and including a circumferential rim and opening means for providing a pouring opening in said cover panel having a predetermined area corresponding to a portion of said cover panel, said opening means including rip means for gripping said opening means, tearing denotation means comprising a first reduced thickness groove provided in said cover panel and defining the periphery of said predetermined area of said portion of said cover panel, said first reduced thickness groove having a first curved portion and a second curved portion, said first curved portion of said first reduced thickness groove being in proximity to said circumferential rim of said cover panel and said second curved portion of said first reduced thickness groove being located between said center of said cover panel and a portion of said circumferential rim which is opposite to said first curved portion of said first reduced thickness groove, said first reduced thickness groove being interrupted at a location corresponding to said second curved portion of said first reduced thickness groove so as to provide a hinge for said portion of said cover panel subsequent to opening of said pouring opening, said grip means being integral with and connected to said portion of said cover panel by first and second reinforcing ribs at a connecting location between said first curved portion of said first reduced thickness groove and said center of said cover panel, and a second reduced thickness groove extending from said connecting location to a location within said predetermined area, thereby defining a strip portion for initiating said opening of said container between said second reduced thickness groove and a corresponding portion of said first reduced thickness groove, said first reinforcing rib being associated with said first reduced thickness groove and said second reinforcing rib being associated with said second reduced thickness groove, thereby facilitating initiation and opening of said container therewith.

2. The container closure of claim 1 wherein said first curved portion has a first radius of curvature, and said second curved portion has a second radius of curvature, said first radius of curvature being longer than said second radius of curvature.

3. The container closure of claim 1, wherein said strip portion is dimensioned such that upon opening of said container by removal of said portion of said cover panel from said poring opening, said grip means is attachable to said circumferential rim of said cover panel.

4. A container closure for a container having an end, said closure comprising a plastic cover panel for covering said end of said container, said cover panel having a center and including a circumferential rim and opening means for providing a pouring opening in said cover panel having a predetermined area corresponding to a portion of said cover panel, said opening means including grip means for gripping said opening means, and tearing denotation means comprising a reduced thickness groove provided in said cover panel and defining the periphery of said predetermined area of said portion of said cover panel, said reduced thickness grove having a first curved portion and a second curved portion, said first curved portion of said reduced thickness groove being in proximity to said circumferential rim of said cover panel and said second curved portion of said reduced thickness groove being located between said center of said cover panel and a portion of said circumferential rim opposite to said first curved portion of said reduced thickness groove, said first curved portion having a first radius of curvature, and said second curved portion having a second radius of curvature, said first radius of curvature being longer than said second radius of curvature, said reduced thickness groove being interrupted at a location corresponding to said second curved portion of said first reduced thickness groove so as to provide a hinge for said portion of said cover panel subsequent to opening of said pouring opening, said grip means being integral with and connected to said portion of said cover panel at a connecting location between said first curved portion of said reduced thickness groove and said center of said cover panel, and means for connecting said grip means to said portion of said cover panel, said means for connecting being defined by first and second reinforcing ribs on opposite sides thereof so as to assist in opening of said container.

* * * * *

UNITED STATES PATENT AND TRADEMARK OFFICE

CERTIFICATE OF CORRECTION

PATENT NO. : 5,133,473

DATED : July 28, 1992

INVENTOR(S) : Lars-Erik Piltz and Patrick Duvander

It is certified that error appears in the above-identified patent and that said Letters Patent is hereby corrected as shown below:

On the title page: Item

[75] delete "Norrangavagen" and insert therefor --Lund--.
delete "Anggatan" and insert therefor --Lund--.

Column 3, line 63, "polyprophylene" should read --polypropylene--.

Column 5, line 15, delete "rip" and insert therefor --grip--.

Column 6, line 22, "grove" should read --groove--.

Signed and Sealed this

Twenty-fourth Day of August, 1993

Bruce Lehman

*Attest:*

BRUCE LEHMAN

*Attesting Officer*

*Commissioner of Patents and Trademarks*